US006029415A

United States Patent [19]

Culpepper et al.

[11] Patent Number: 6,029,415

[45] Date of Patent: Feb. 29, 2000

[54] LAMINATED VINYL SIDING

[75] Inventors: Patrick M. Culpepper, Dover, Ohio; Richard C. Wilson, West Bloomfield, Mich.

[73] Assignee: ABCO, Inc., Beach City, Ohio

[21] Appl. No.: 08/957,564

[22] Filed: Oct. 24, 1997

[51] Int. Cl.[7] ..... E04D 1/00

[52] U.S. Cl. ..... 52/522; 52/535

[58] Field of Search ..... 52/518–520, 309.9, 52/522, 530, 535, 553, 534, 536, 407.1, 588.1, 309.4, 309.5, 309.8

[56] References Cited

U.S. PATENT DOCUMENTS

| | | | |
|---|---|---|---|
| D. 274,947 | 7/1984 | Culpepper | D25/73 |
| 2,091,316 | 8/1937 | Hauck . | |
| 2,231,008 | 2/1941 | Ochs | 20/5 |
| 2,311,245 | 2/1943 | Pearl | 45/24 |
| 2,373,789 | 4/1945 | Smith | 20/4 |
| 2,450,562 | 10/1948 | Robinson et al. | 108/13 |
| 3,159,943 | 12/1964 | Sugar et al. . | |
| 3,391,509 | 7/1968 | Fruman | 52/367 |
| 3,500,600 | 3/1970 | Bagley | 52/211 |
| 3,525,188 | 8/1970 | Torbett | 52/288 |
| 3,826,054 | 7/1974 | Culpepper | 52/309 |
| 3,828,499 | 8/1974 | Leddy | 52/278 |
| 4,033,802 | 7/1977 | Culpepper et al. | 156/71 |
| 4,081,939 | 4/1978 | Culpepper et al. | 52/535 |
| 4,189,885 | 2/1980 | Fritz | 52/287 |
| 4,315,390 | 2/1982 | Schaafsma | 52/288 |
| 4,319,439 | 3/1982 | Gussow | 52/288 |
| 4,388,361 | 6/1983 | Vassalli | 428/192 |
| 4,399,643 | 8/1983 | Hafner | 52/530 |
| 4,506,486 | 3/1985 | Culpepper et al. | 52/529 |
| 4,545,162 | 10/1985 | Attaway | 52/255 |
| 4,706,426 | 11/1987 | Rumsey | 52/232 |
| 4,827,683 | 5/1989 | Poole | 52/316 V |
| 4,949,520 | 8/1990 | Bear | 52/288 |
| 5,016,415 | 5/1991 | Kellis | 52/522 |
| 5,090,174 | 2/1992 | Fragale | 52/309.9 |
| 5,444,953 | 8/1995 | Koenig et al. | 52/282.1 |
| 5,542,222 | 8/1996 | Wilson et al. | 52/287.1 |
| 5,664,376 | 9/1997 | Wilson et al. | 52/287.1 |

FOREIGN PATENT DOCUMENTS

| | | | |
|---|---|---|---|
| 2015134 | 4/1970 | France | 52/529 |
| 1354483 | 5/1974 | United Kingdom . | |

*Primary Examiner*—Beth Aubrey
*Attorney, Agent, or Firm*—Young & Basile, P.C.

[57] ABSTRACT

A composite interlocking vinyl or other veneer siding having an elongated insulating member bonded to a vinyl panel with a permanently flexible adhesive that is compatible with both vinyl and insulation material and does not harden. The insulating member is configured such that a front face of the insulating material exactly coincides with the profile of the front face of the vinyl member. The insulating member forms a shallow shelf at an upper edge of the insulating member and an adjacent insulating member forms another shelf to overlap the adjacent shallow shelf to form a shiplap seal when assembled. Horizontal and vertical edges of the vinyl siding and insulating member are configured to overlap when mounted.

25 Claims, 3 Drawing Sheets

LAMINATED VINYL SIDING

FIELD OF THE INVENTION

The present invention is concerned with lap siding panels of a certain type wherein elongated siding panels of vinyl or other new generations of veneer siding are laminated to a foam insulating material and formed with mating, interlocking means along their opposed longitudinally spaced edges for interlocked installation on a building wall for imitation of conventional wooden lap siding.

BACKGROUND OF THE INVENTION

Metal panels of this type have been known in the art. The panels function solely to provide a weatherproof exterior sheathing of the buildings and do not provide any structural support. The panels are conventionally made of a relatively thin material which does not provide any substantial heat insulation to the building or structural support. In an effort to reduce material costs, various vinyl siding manufacturers have reduced the thickness of their siding panels. However, subsequent performance and appearance complaints have caused the industry to establish a minimum thickness of 0.035". Accordingly, it has been proposed to back such panels with board like members of heat insulating material. Although insulating material has successfully been laminated to aluminum siding, inherent problems were associated with the lamination of insulating material for vinyl siding.

Unlike aluminum and steel siding which can be manufactured with flat faces, vinyl siding has to be manufactured with an unnatural appearing concave face. The concave or mechanical set face was introduced to vinyl siding panels to reduce or eliminate the occurrence of oil canning. Oil canning is a condition where unacceptably large bubbles or distorted areas appear on the face of the siding panel. Oil canning occurs during changing temperature and weather conditions when the vinyl expands and contracts; and because the vinyl is thin and cannot maintain its own shape. The mechanical set of a concave face diminishes the oil canning problems which have presented substantial warranty costs to the industry. However, this problem has caused the industry to limit the exposure of the horizontal siding to ten or eleven inches. (A ten inch exposure provides two five inch faces.) Vinyl panels wider than 10–11" have been withdrawn from the market because the panels failed to perform up to industry standards. Despite the improvements, oil canning continues to represent significant customer dissatisfaction and warranty claims.

For added insulation, aluminum siding jobs used drop-in backer boards. Initially, the same foam drop-in backer boards were also used for vinyl siding jobs, but were quickly prohibited by vinyl siding producers. The flat surfaces associated with the thin drop-in foam insulation tended to straighten out the concave set placed in vinyl siding faces to resist oil canning. The flat surface drop-in insulation material had been designed specifically for use with aluminum siding and was not configured to be compatible with the new concave set of the vinyl faces. Further, mechanical binding or obstructions developed between the vinyl and insulation materials at some job sites, because of poor application techniques. Because the previous drop-in foam insulation panels were thin and lacked a registration point, it was easy for the applicator to drop the backer board into the vinyl siding lock mechanism. Then, when the vinyl siding panel was locked into place, the backer board would be trapped in the vinyl siding's interlocking mechanism, thereby restricting the movement of the vinyl siding panel. As a result, the vinyl siding industry banned the use of drop in backer boards. The vinyl siding panel needs to freely move to accommodate its high coefficient of expansion and contraction. If the backer board was trapped in the interlocking mechanism, further distortion occurred in the vinyl siding. In addition, the drop-in backer boards were not manufactured with a consistent thickness. The foam thickness was often varied from run to run and manufacturer to manufacturer resulting in a unacceptable, uneven, poorly appearing wall.

Another problem relating to the lamination of vinyl siding and insulating material is a condition called "telegraphing". This is a condition that occurs when the adhesive glue line is seen under certain lighting conditions through the face of the siding. The telegraphing condition provides an unacceptable appearance. Therefore, a different adhesive and application system is required to solve the telegraphing problem. At the same time it is necessary to provide an adhesive that is compatible with both the vinyl and insulation material and will hold the siding faces to the insulation material for the entire life of the vinyl siding. In addition, the adhesive must remain flexible throughout the entire life of the composite product.

Another problem occurring in the industry with the vinyl siding installed over current insulation materials is that the vertical edges of adjacent vinyl siding panels often do not lay flat as a result of the deformation of the shape of the vinyl due to improper manufacturing, handling or installation. The resulting open lap is unacceptable from an aesthetic standpoint and, the siding panels can be subject to water, dirt and debris, as well as air infiltration.

Still another problem occurring in the industry with the insulation material is that the vertical edges of adjacent drop-in backer board insulation panels do not provide adequate insulation and structural strength for the vinyl. The current drop-in backer board insulation does not provide a seal between vertically adjacent vinyl siding panels since the insulation material does not extend to the vertical edges.

SUMMARY OF THE INVENTION

It is the intention of the current invention to address the aforementioned concerns. In accordance with the present invention, a board like insulating member is formed to be bonded to a vinyl panel. The insulating member has a coefficient of expansion and contraction which is essentially the same as the vinyl panel. The insulating member is configured such that horizontal and vertical edges of adjacent insulating members overlap each other when installed to provide an airtight seal while not interfering with the interlocking ends of the vinyl siding. This arrangement effectively reduces thermal loss due to air infiltration. The configuration of the insulating member is such that the rear surface of the insulating member has a generally flat surface; and the front surface of the insulating board is configured to coincide with the exact profile of the vinyl sheet. The intent of this feature is to provide support for the vinyl and to make the siding look and feel more like wood. This feature also increases the impact and crack resistance of the vinyl siding by supporting the surface profile of the panel. The profile of the insulating board includes a mid-butt extension coinciding with the simulated overlap extension of the vinyl sheet. The mid-butt extension of the insulating board also serves as a registration point to maintain the insulating backer in its proper location and to prevent it from sliding into the top and bottom longitudinal locks of the vinyl siding. This feature also provides a custom cut cradle, or bed, for the vinyl that is consistently manufactured to the vinyl manufacturer's intended profile. As a result, the insulating board will provide a correct and consistent base upon which the vinyl is laminated.

The vinyl siding is laminated to the insulating board by means of an adhesive that provides some elongation factor. The adhesive is a type that does not harden over time and is compatible with both vinyl and foam over the long term to prevent degradation, discoloration or other defects to the vinyl. The adhesive bonds the vinyl to a foam cradle thereby conforming the vinyl to a stronger and dimensionally consistent backer system; such that all composite panels will conform consistently to the manufacturer's intended design shape and overcome the inconsistencies experienced in the field currently due to poor warehousing, shipping, and installation practices. By bonding the vinyl to the foam, distortion or random waving of the vinyl is significantly reduced that is caused primarily by a change of temperature, poor manufacturing or poor installation techniques. Having a custom cut insulation member will hold the vinyl to the design shape in spite of the aforementioned conditions. Further, bonding the vinyl to the insulating member eliminates the need to design a concave set into the face of the vinyl panels. Ultimately, the vinyl siding industry would prefer to eliminate the concave set and return to the flat surface face to more accurately simulate the wood lap siding. The face of the composite panel will not distort during changes of temperature as current designs do, thereby eliminating the need for the concave set currently designed into vinyl siding products.

Laminating the vinyl siding to the insulating member will greatly increase the rigidity of the siding. The resulting increased rigidity will allow the composite product to bridge uneven wall surfaces better and create a more appealing finished appearance on the wall. The finished product will have less sag and be easier to handle during application.

Further, laminating the vinyl to the insulating member will allow siding companies to design products with faces/exposures over ten or eleven inches.

This is a result of the foam bed that supports the profile of the vinyl, such that the faces/exposures of up to and greater than 48" are realistically achievable. This will also provide significant material and installation labor savings. Likewise, the lamination of the two materials will improve the performance and allow siding companies to design laminated products less than 0.035" thick for further material cost savings. As a result of the lamination, the composite panel now has the strength and support even at reduced gauges and increased widths to provide the necessary performance. By laminating the vinyl to the insulating member in the factory, the two step, in field installation procedure currently used is no longer required. Therefore, insulation installation labor is eliminated.

Other objects, advantages and applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DESCRIPTION OF THE PREFERRED EMBODIMENT

Figure 1:
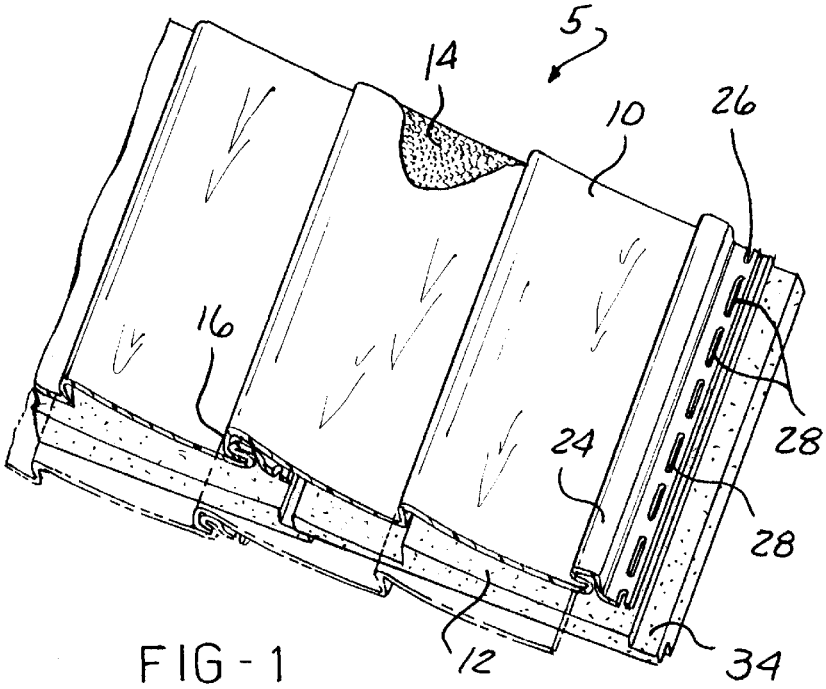
FIG. 1 is a perspective view of end portions of a vinyl panel and insulating member.

The composite and laminated vinyl siding 5 embodying the present invention is shown to include a vinyl outer panel 10 and a board like insulating member 12 that is adhesively bonded to the rear surface of the vinyl panel. The adhesive material 14 that is used must be of a special type that does not harden, remains flexible once cured to allow relative movement of the vinyl 10 against the insulating member 12, does not attack the vinyl 10, in order to prevent degradation, discoloration, deformation or other defects to the vinyl 10, and is compatible to both the vinyl and the insulating member over the long term. The type of adhesives 14 preferred includes a moisture cured urethane, such as manufactured by Ashland Chemical Company of Columbus, Ohio known as ISOGRIP 3030D. Other alternatives include a heat and pressure sensitive adhesive, or a latex based adhesive.

The particular vinyl panel of the current invention is formed having an inwardly projecting lower edge or butt 16 and an interlocking lip forming the male portion of the locking system 18 extending therefrom. The vinyl panel 10 generally includes a plurality of front faces 20 separated by intermediate or mid-butt edges 22 that connect one face portion 20 to another face portion to simulate conventional wooden lap siding. The vertical dimension may exceed the industry's self-imposed ten inch maximum.

Figure 2:
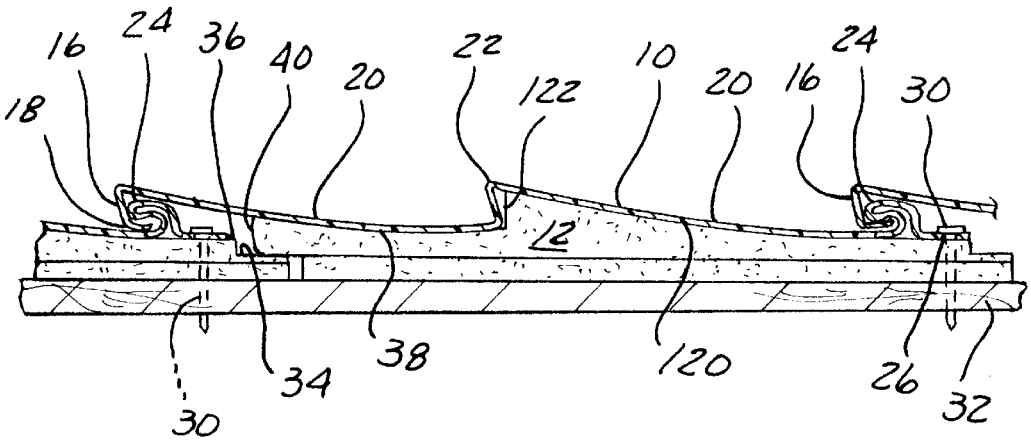
FIG. 2 is a perspective view of the end portions of two adjacent composite panels showing the panels in interlocking relationship with each other.

The front face portion 20 of the panel 10 may be a straight planar surface to simulate a wood panel or the vinyl siding panel 10 may be designed with a concave set to the front face profile as is currently manufactured. FIGS. 1 and 2 show the concave set of the front faces 20. It should be noted that with the improved adhesive bonding applied to a contoured backer, the vinyl siding 10 no longer requires the concave set to the front face 20 and therefore can be manufactured to simulate more realistic wood production.

FIGS. 1 and 2 show one current locking mechanism used in the industry, but other locking mechanisms are available. At the opposite edge of the vinyl panel 10 from the male portion of the lock 18, the entire width of the panel 10 is crimped and folded to form the female portion of the lock 24 that provides an inwardly facing groove for receiving the male portion of the lock 18 of an adjacent vinyl panel 10. Immediately above the female portion of the lock 24, a nailing hem 26 having a series of apertures 28 is formed at the top end of the panel. The vinyl panel 10 is installed by means of nails 30 which pass through the apertures 28 in the nailing hem 26 and through the underlying insulating member 12 to mount the individual composite panel 5 in position upon a building frame 32.

The insulating member 12 is manufactured having front faces 120 with the same exact profile as the front faces 20 of the vinyl member 10. The front faces 120 are intersected by corresponding mid-butts 122 of the insulating member to coincide with the intermediate edges or mid-butts 22 of the vinyl sheet 10. The upper horizontal end of the insulating member 12 forms a shallow shelf 34. Shelf 34 forms one-half of a shiplap sealing mechanism. The nailing hem 26 is positioned and aligned at a top edge of a forward surface 36 of the shelf. The forward surface 36 of the shelf 34 is integral with the face 120 of the insulating member 12. The bottommost front face 38 of the insulating member is actually only a partial front face. This partial front face 38 is configured to extend only a portion of the width of the front face 20 of the vinyl panel 10 to allow free movement of the locking system. The partial front face 38 ends to an inwardly formed ledge 40. The ledge 40 forms a recess 42 to receive an adjacent shelf 34 from an adjacent vinyl composite member 5.

Except for the recess portion 42 of ledge 40, the back surface 44 of the insulating member 12 is essentially planar. The planar back surface 44 provides the advantages of easy installation over a building frame 32. Once the insulating member has been cut to the manufacturers specifications, the insulating member can be bonded to the vinyl panel 10. A moisture cured urethane adhesive 14 or other tested adhesive that remains flexible after curing is applied across a large portion of the faces 120 and 38 of the insulating member 12. The adhesive material 14 is spread across the face and not applied as a single bead. The application of the adhesive may be by roll coating, stitching, extruding, spraying or curtain coating. This adhesive type and application procedure prevents the telegraphing distortion. As previously indicated, the vinyl panel 10 is aligned onto the insulating member 12 by positioning the nailing hem 26 along the upper edge of the forward surface 36 or shelf 34. At the same time the intermediate edges 122 of the insulating member 12 will be aligned under the intermediate edges 22 of the vinyl panel 10. After the two materials are laminated together, the composite vinyl and insulating member 5 is transported to the building site.

Figure 3:
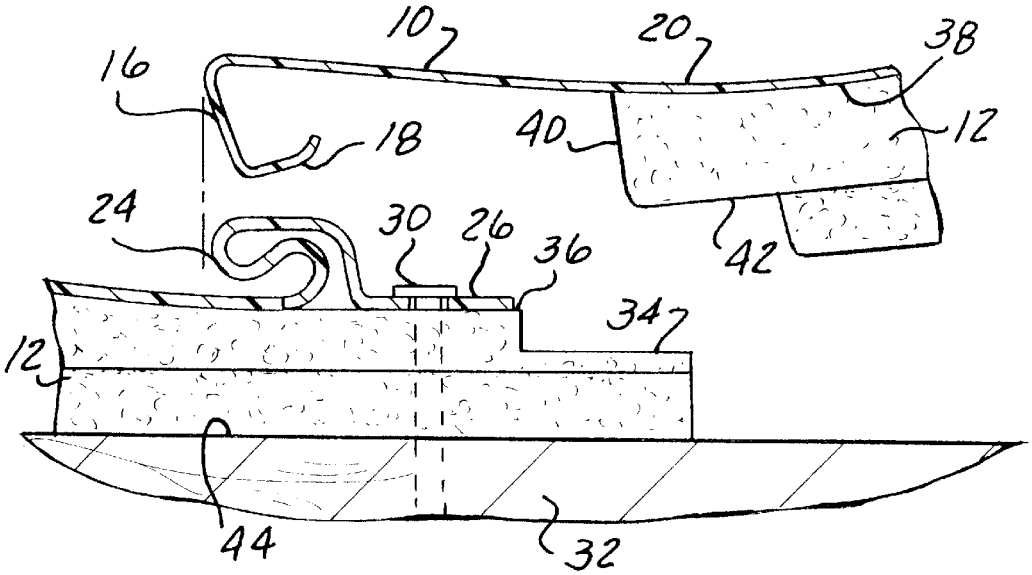
FIG. 3 is a detailed cross sectional view of the interlocking edges of the adjacent vinyl panels.
Figure 4:
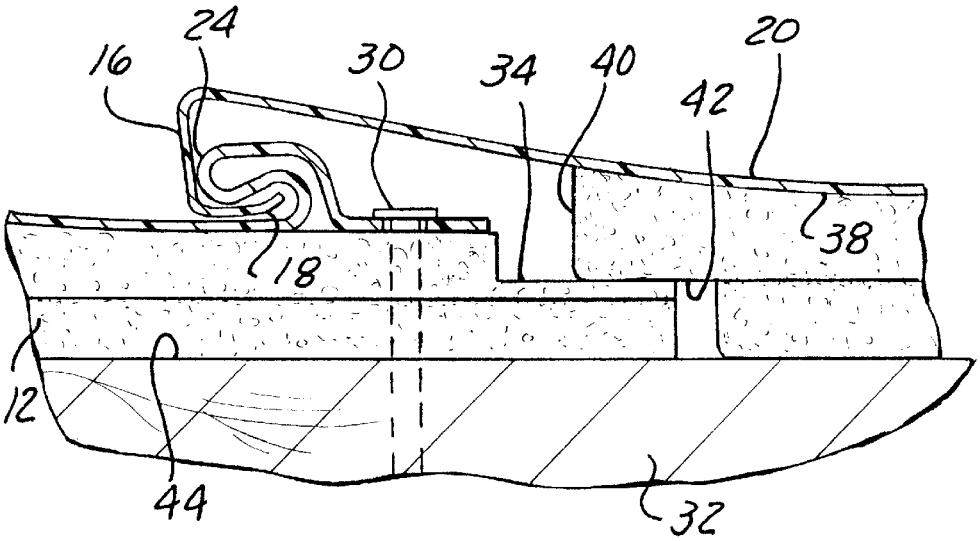
FIG. 4 is a detailed cross sectional view of the interlocking edges of the adjacent vinyl panels in an installed position.

Looking at FIGS. 3 and 4, installation of an upper composite panel 5 is performed without interference by interlocking the male portion of the lock 18 of the upper and adjacent vinyl panel 10 into the female portion of the lock 24 of the lower adjacent vinyl panel 10. The lower ledge 40 of the upper and adjacent composite panel 5 is spaced away from the adjacent panel's female portion of the lock 24. Therefore, the insulating member 12 does not interfere or bind with the interlocking mechanism consisting of male 18 and female 24 portions of the lock. When assembled, a shiplap seal is formed between the two adjacent composite panels. At the same time, the building frame 32 is completely covered by the insulating material 12.

Figure 5:
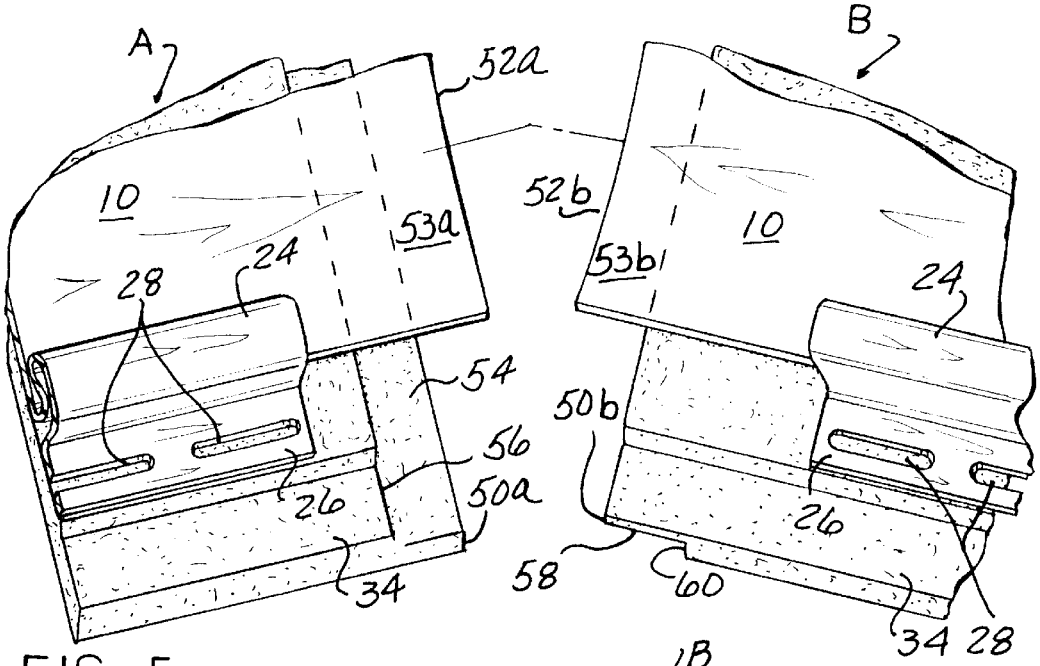
FIG. 5 is a fragmentary perspective view of vertical edges of adjacent vinyl panels.
Figure 6:
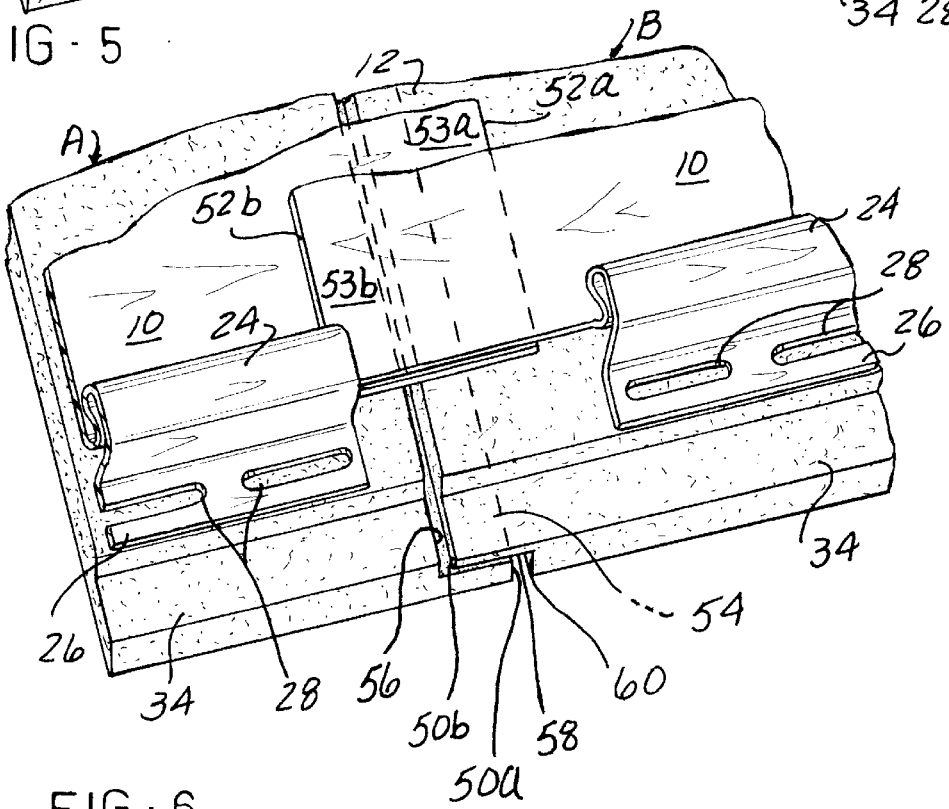
FIG. 6 is a fragmentary perspective view of the vertical edges of FIG. 5 in an installed position.

FIGS. 5 and 6 show cut-away perspective portions of two adjacent vertical sides of the composite panel 5 to illustrate the vertically extending overlap system. FIGS. 5 and 6 show the top portion of the composite panel to show the relationship of the female portion of the lock 24 and nailing hem 26 on one composite panel 5 to those elements of an adjacent composite panel 5 when installed. Each composite panel 5 will have two vertically extending edges as represented by portions A and B in FIG. 5. The vinyl sheet 10 will extend approximately one inch beyond the outermost vertical edges 50*a* and 50*b* of the insulating member 12 forming flaps 53*a* and 53*b* respectively. As can be seen, the female portion of the lock 24 and nailing hem 26 do not extend the entire horizonal length of the vinyl sheet 10, but stop approximately one and a half inches away from the innermost vertical edges 56 and 60 of the vinyl sheet 10 on each side. Looking first at vertical portion A, the insulating member 12 is cut to form a lower shelf 54 that extends the entire vertical width of the insulating member 12. The lower shelf 54 has a length of approximately ¾ inch, and forms the vertical surface 56. The female portion of the lock 24 and nailing hem 26 end approximately ½ inch from the innermost vertical surface 56. Looking now at vertical portion B, the insulating member 12 is cut to form an upper shelf 58 that complements lower shelf 54. Upper shelf 58 terminates at the innermost vertical surface 60. Upper shelf 58 and innermost vertical surface 60 extend the entire vertical width of the insulating member 12.

Although much of the exterior surface of the insulating member 12 is adhered to the vinyl panel, the adhesive 14 does not extend horizontally beyond the nailing hem 26. As a result, the extending flaps 53*a* and 53*b* may be gently pulled slightly away from the insulating member 12. When two horizontally adjacent composite panels 5 are installed onto a building frame 32, one of the extending flaps 53*a* or 53*b* will slide between the adjacent extending flap and its insulating member 12. Looking at FIGS. 5 and 6, extending flap 53*a* is slid under extending flap 53*b* to lie between extending flap 53*b* and its insulating member 12. At the same time, upper shelf 58 rests on top of lower shelf 54 in complementary form to form a shiplap seal such that vertical edge 50*b* is adjacent but does not abut vertical surface 56, and vertical edge 50*a* is adjacent but does not abut vertical surface 60. In fact, a gap of approximately one half inch is preferred between the vertical edges and vertical surfaces to accommodate thermal expansion. The overlap of lower and upper shelves 54 and 58 respectively provides continuous insulation along the vertical edges. Further, the overlap of extending flaps 53*a* and 53*b* mechanically holds the lap or seam line closed for better appearance, and also reduces air, water, and debris infiltration behind the vinyl panel. Although FIG. 6 shows extending flap 53*b* extending over flap 53*a*, the extending flaps may also overlap in the other direction so that extending flap 53*a* extends over extending flap 53*b*. The decision of which extending flap 53*a* or 53*b* is purely aesthetic to avoid a view of the seam line from the street or front of the building. The vertically extending ends of the outer panel extend beyond the vertically extending ends of the insulating material.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. In a composite siding panel having an elongate outer panel formed from vinyl with first and second spaced longitudinally extending edges with a nailing hem adjacent one of the first and second longitudinally extending edges of the outer panel, the improvement comprising:

an elongate insulating member having a plurality of flat planar outer surfaces separated from one another by at least one shoulder surface to define a stepped contour, each flat planar outer surface secured to an inner surface of the outer panel with a permanently flexible adhesive to form a laminated composite siding panel, the insulating member having first and second longitudinally extending ends, wherein said first longitudinally extending end extends beyond said nailing hem.

2. The improvement of claim 1, wherein the outer surface of the insulating member has a complementary profile with respect to the inner surface of the outer panel.

3. The improvement of claim 1, wherein the nailing hem is on the first edge of the outer panel and the second edge of the outer panel extends beyond the second longitudinally extending end of the insulating member.

4. The improvement of claim 1, wherein the first longitudinally extending end of the insulating member defines a shelf and the second longitudinally extending end defines a shelf-receiving recess, such that the shelf-receiving recess is approximately a mirror image of the shelf so that the first and second longitudinally extending ends of adjacent insulating members are adapted to overlap each other when two adjacent outer panels are interlocked with respect to one another.

5. The improvement of claim 1, wherein one of the vertically extending edges of the insulating member forms a shelf and the other vertically extending edge of the insulating member forms a shelf-receiving recess, such that the shelf of one insulating member is adapted to overlap the shelf-receiving recess of a horizontally adjacent insulating member to form a seal when two horizontally adjacent composite siding panels are installed with respect to one another.

6. The improvement of claim 1, wherein the vertically extending edge of the outer panel of one composite siding panel is adapted to be received between a second vertically extending end and insulating member of an adjacent composite siding panel when two horizontally adjacent composite siding panels are installed with respect to one another.

7. A composite siding panel comprising:

an elongate outer panel formed of thin material having first and second spaced longitudinally extending edges with a predetermined profile extending therebetween;

interlocking means extending along each of said first and second spaced edges for releasibly connecting a first edge of one panel with a second edge of an adjacent panel during installation;

an elongate insulating member having an outer surface with a complementary profile with respect to an inner surface of the outer panel, said insulating member having a generally flat inner surface portion and having first and second longitudinally extending ends, said first and second longitudinally extending ends forming first and second complementary shelves respectively such that adjacent composite siding panels are adapted to position said complementary shelves in overlapping relationship with respect to one another to form a seal when two adjacent composite side panels are secured in interlocking relationship; and a permanently flexible adhesive securing the insulating member to the inner surface of the outer panel.

8. The composite siding panel of claim 7, wherein the first edge of the outer panel defines a nailing hem positioned proximate the first longitudinally extending end of the insulating member on an outer surface of the first shelf.

9. The composite siding panel of claim 8, wherein the second edge of the outer panel extends beyond the second longitudinally extending end of the insulating member.

10. The composite siding panel of claim 7, wherein the insulating member is secured to the inner surface of the outer panel with a moisture cured urethane adhesive.

11. The composite siding panel of claim 7, wherein the elongate outer panel and insulating member have vertically extending edges and ends respectively, and the vertically extending edges of the outer panel extend longitudinally beyond the vertically extending ends of the insulating member.

12. The composite siding panel of claim 11, wherein one of the vertically extending ends of the insulating member forms a shelf and the other vertically extending end of the insulating member forms a shelf-receiving recess, such that the shelf of one insulating member is adapted to overlap the shelf-receiving recess of a horizontally adjacent insulating member to form a seal when two horizontally adjacent composite siding panels are installed with respect to one another.

13. The composite siding panel of claim 11, further comprising means for defining a nailing hem on one of the first and second spaced longitudinally extending edges of the outer panel wherein a horizontal dimension of the nailing hem is less than a horizontal dimension of the insulating member.

14. The composite siding panel of claim 11, wherein the vertically extending edge of the outer panel of one composite siding panel is adapted to be received between a second vertically extending end and insulating member of an adjacent composite siding panel when two horizontally adjacent composite siding panels are installed with respect to one another.

15. The composite siding panel of claim 11, wherein the vertically extending edge of the outer panel of a first composite siding panel is disposed between the vertically extending edge of the outer panel and the insulating member of an adjacent composite siding panel when installed with respect to one another.

16. The composite siding panel of claim 7, wherein the thickness of the outer panel is less than 0.035".

17. The composite siding panel of claim 7, wherein the width of the outer panel is greater than 12 inches.

18. The composite siding panel of claim 7, wherein the insulating member is secured to the inner surface of the outer panel with a permanently flexible adhesive selected from the group consisting of a heat and pressure sensitive adhesive, a latex based adhesive, and a moisture cured urethane adhesive.

19. The composite siding panel of claim 7, wherein the insulating member increases impact and crack resistance of the vinyl siding panel by supporting a full surface profile of the vinyl siding panel.

20. A composite siding panel comprising:

an elongate outer panel of weather impervious material having first and second longitudinally extending edges, and first and second transversely extending ends;

a fastening hem extending longitudinally along the first edge of the outer panel;

interlocking means formed on the outer panel and defined by a male portion extending longitudinally along the second edge and a complementary female portion adjacent to and extending longitudinally along the first edge for interlocking two vertically adjacent outer panels in parallel, abutting edge-to-edge relationship with respect to one another;

an insulating member mounted to an inner surface of the outer panel and extending outwardly beyond the first edge of the outer panel, while spaced inwardly from the second edge and spaced inwardly from at least one of the first and second ends of the outer panel; and means for sealing a transversely extending end joint between horizontally adjacent composite panels when in abutting end-to-end relationship with one another with at least one staggered, overlapping joint disposed between the ends of the adjacent composite panels.

21. The composite siding panel of claim 20, wherein the sealing means further comprises:

the insulating member having mating, overlapping, complementary male and female portions extending transversely along opposite ends.

22. The composite siding panel of claim 20, wherein at least one of the overlapping joints defines a rabbet joint between adjacent composite panels.

23. A backing member for a composite siding panel comprising:

an elongate insulating member having a uniform cross section along substantially an entire longitudinal length with a plurality of outer surfaces separated from one another by at least one shoulder surface to define a stepped contour on a front face, the insulating member having first and second transversely extending edges, wherein the first transversely extending edge of the insulating member defines a projection and the second transversely extending edge defines a projection-receiving recess, such that the projection-receiving recess is approximately a mirror image of the projection so that the first and second transversely extending edges of two horizontally adjacent insulating members are adapted to overlap each other when two horizontally adjacent insulating members are assembled with respect to one another.

24. The backing member of claim 23 further comprising:

the insulating member having first and second longitudinally extending edges, wherein the first longitudinally extending edge of the insulating member defines a second projection and the second longitudinally extending edge defines a second projection-receiving recess, such that the second projection-receiving recess is approximately a mirror image of the second projection so that the first and second longitudinally extending edges of two vertically adjacent insulating members are adapted to overlap each other when two vertically adjacent insulating members are assembled with respect to one another.

25. The backing member of claim 23 further comprising:

the plurality of outer surfaces on the front face of the insulating member defining at least two flat planar outer surfaces, each flat planar outer surface adapted to receive a permanently flexible adhesive layer engageable with an inner surface of an outer panel of weather impervious material to define a composite siding panel.

* * * * *